United States Patent [19]

Aginar

[11] 4,235,473

[45] Nov. 25, 1980

[54] FURNITURE CONSTRUCTION

[76] Inventor: Antonio F. Aginar, 188-22 Jamaica Ave., Hollis, N.Y. 11423

[21] Appl. No.: 933,490

[22] Filed: Aug. 14, 1978

[51] Int. Cl.[3] ..... A47C 7/00

[52] U.S. Cl. ..... 297/440; 297/445

[58] Field of Search ..... 297/440, 443, 445, 447, 297/452–454, 456

[56] References Cited

U.S. PATENT DOCUMENTS

| | | | |
|---|---|---|---|
| 3,743,353 | 7/1973 | Lupinsky | 297/445 |
| 4,052,104 | 10/1977 | Noss | 297/456 |

FOREIGN PATENT DOCUMENTS

| | | | |
|---|---|---|---|
| 2557918 | 9/1976 | Fed. Rep. of Germany | 297/440 |
| 1438493 | 6/1976 | United Kingdom | 297/440 |

*Primary Examiner*—James C. Mitchell

*Attorney, Agent, or Firm*—Jacobs & Jacobs

[57] ABSTRACT

Furniture is constructed from a plurality of units, each unit having a uniform thickness and a pair of parallel side faces with at least one shaped edge surface. The composite of the edge surfaces of the units, when arranged in a predetermined, spaced face-to-face relationship, defines at least one functional surface of the furniture piece. A plurality of discrete spacer means, the function of which can be fulfilled by a second plurality of similar or dissimilar units, are disposed between the opposed side face of the units, so as to space the units from one another in the desired spaced relationship and the units and spacing means are held in this relationship through interconnecting means. Second, third or more pluralities of different units can be employed, the units of any given plurality being interposed between the opposed faces of units of another plurality.

7 Claims, 10 Drawing Figures

FURNITURE CONSTRUCTION

DETAILED DESCRIPTION

The present invention pertains to the construction of furniture from rigid materials such as wood, plastics and metals. The construction described herein can be utilized for virtually any type of furniture including chairs, couches, chaise longues, desks, tables, hassocks, stools, bed frames, bookcases and the like. It is an object of the present invention to provide furniture pieces which can be readily mass produced and assembled, easily transported, either in assembled or knocked down form, and adapted for either assembled or kit distribution. Significantly, the furniture constructed according to the present method displays a characteristic and distinctive style which, in addition to enhancing the use of individual pieces, also lends itself to the gathering of several pieces in suite or ensemble arrangement.

These and other objects of the invention will be apparent from the following description and from the drawings in which FIG. 1 is a perspective view of a furniture piece constructed according to the present invention and suitable, for example, as a coffee table or, with slightly modified proportions, a bed frame;

Figure 1:
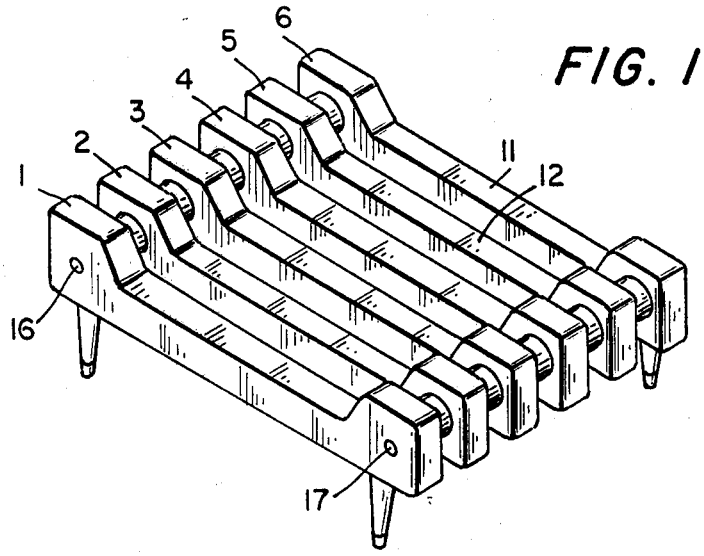
Figure 2:
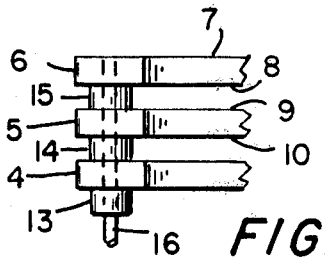
FIG. 2 is a top view of a corner portion of the embodiment shown in FIG. 1.
Figure 3:
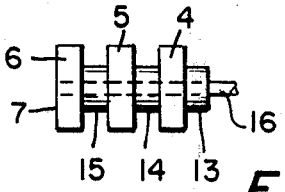
FIG. 3 is a side view of the corner portion shown in FIG. 2.

Referring now to the figures in greater detail, there is shown in FIGS. 1, 2 and 3, a furniture piece comprising a plurality of units 1, 2, 3, 4, 5 and 6. The number in the plurality is not critical and is matter of design choice. Each unit is of a uniform thickness and, as seen in FIGS. 2 and 3, presents parallel side faces 7 and 8 for unit 6 and parallel side faces 9 and 10 for unit 5. Each of the units presents at least one shaped edge surface, surface 11 for unit 6 and surface 12 for unit 5, etc. The edge surface may be essentially planar or involve a plurality of planes and curves, the critical aspect of the edge surfaces being that a composite of portions of edge surfaces of all the units defines at least one functional surface of a furniture piece when the units are arranged in a predetermined spaced face-to-face relationship. Thus, for example, in the embodiment shown in FIG. 1, the respective shaped upper edge surface of the individual units 1, 2, 3, 4, 5 and 6 when arranged in a predetermined spaced face-to-face relationship define a functional surface corresponding to the upper surface of a low table or a bed frame.

In order to maintain the individual units in the predetermined spaced face-to-face relationship, there are provided a plurality of spacer means 13, 14 and 15. These may be of substantially any shape, including circular, rectangular, hexagonal and the like. Interconnecting means 16 and 17 are provided to maintain the units in the spaced relationship. Interconnecting means may be a simple rod, such as a dowel, passing through the individual units and the spacing means, in which case the units and the spacing means are provided with registered holes to admit passage of the dowel, with the dowel being locked in position either by friction, a suitable adhesive, or conventional fasteners such as nails or screws. Alternatively, the interconnecting means can be a nut and bolt, again passing through registered holes in the individual units and the spacing means. It is not necessary that the interconnecting means pass through the spacer means but generally this is desirable for esthetic reasons. At least one of the spacer means is disposed between the opposed faces of any two adjacent units but generally there will be more than one. Two or more spacer means between opposed faces of any given two adjacent units can be the same or different.

Figure 4:
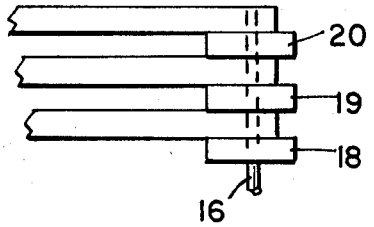
FIG. 4 is a top view of a corner portion of a furniture piece showing spacing means alternative to those as shown in FIG. 2.
Figure 5:
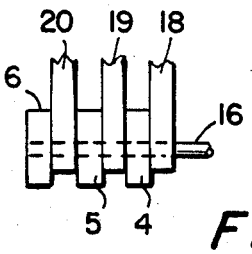
FIG. 5 is a side view of the embodiment shown in FIG. 4.

As shown in FIGS. 4 and 5, the spacer means may extend beyond the edge of the units and indeed may be constituted by a second plurality of units defining a second functional surface of the furniture piece. This is shown in greater detail in connection with subsequent embodiments of the invention but suffice it to note that such a second plurality of units 18, 19 and 20, in addition to defining a second furniture surface can also function as the spacing means.

Figure 6:
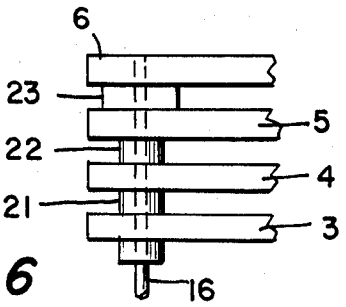
FIG. 6 is a top view of a corner portion showing a combination of the embodiment shown in FIGS. 2 and 4.
Figure 7:
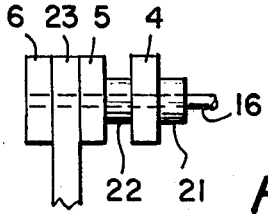
FIG. 7 is a side view of the embodiment shown in FIG. 6.

It is also possible as shown in FIGS. 6 and 7 to have combinations of the previous arrangements. Thus spacing means 21 and 22 perform only a spacing function while spacing means 23 also performs a second function, such as serving as a support for a further component of the furniture piece or as a leg of the furniture piece.

Figure 8:
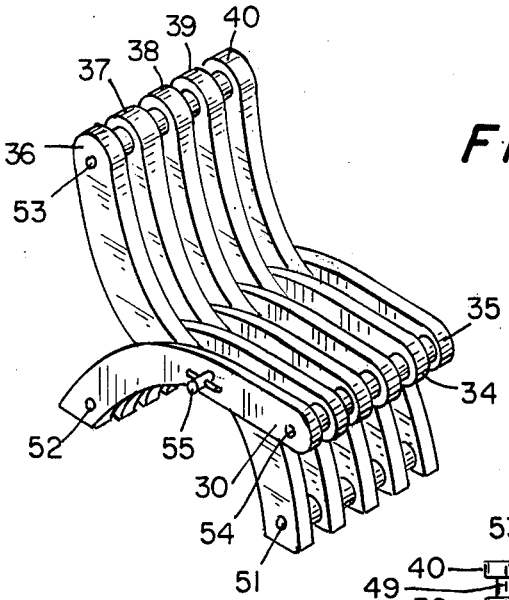
FIG. 8 is a perspective view of a chair constructed in accordance with another embodiment of the present invention.
Figure 9:
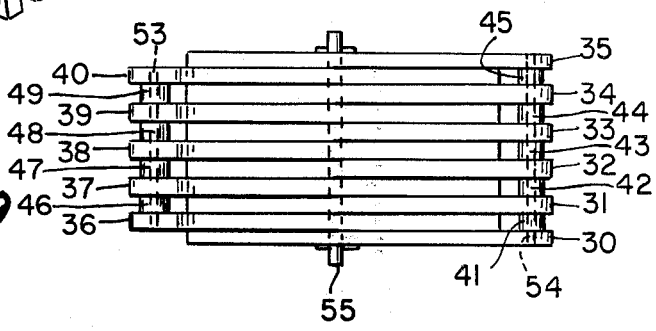
FIG. 9 is a top view of the chair shown in FIG. 8.

There is shown in FIGS. 8 and 9 a chair which utilizes a first and second plurality of units, each defining separate and transverse functional surfaces of the furniture piece. First plurality of units 31, 32, 33 and 34 and 35, as a composite, thus define the seat of the chair while the second plurality of units 36, 37, 38 and 39 and 40, as a composite, define a second functional surface, namely the back of the chair. With reference to the first plurality of units, it will be noted that there are three spacing means between any two opposing side faces, a first series of annular sleeves 41, 42, 43, 44 and 45 disposed between the open faces of adjacent units 31 through 35 at one end of those units, a like series of spacer units 46, 47, 48 and 49 disposed between the same opposed face of the same units at the other end of those units, and, approximately in the median of the units, the second plurality of units 36 through 40 which are interposed between portions of the adjacent pairs of the units of the first plurality. It is of course not necessary that the two pluralities of units be contiguous only at their respective midpoints.

Interconnecting means 51, 52, 53 and 54 cooperating with the associated spacing means maintain the units rigidly in a predetermined spaced relationship. Interconnecting means 55 serves the same function with respect to each individual plurality of units but can be designed to permit hinge movement of one plurality relative to the other plurality for folding (conventional stop means, not shown, would of course be present to prevent collapse of the chair when unfolded).

Figure 10:
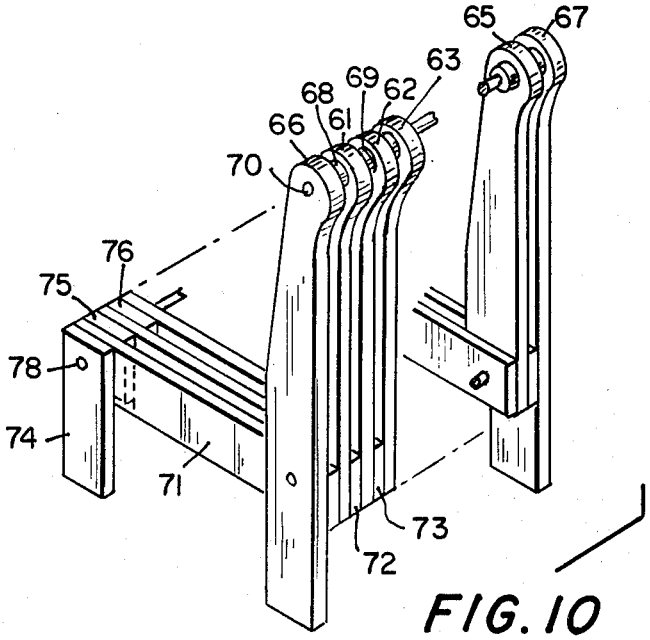
FIG. 10 is a perspective view of a chair constructed in accordance with a further embodiment of the present invention.

In the embodiment shown in FIG. 10, units 61, 62, 63, and 65 constitute the first plurality of units. Their composite defines the back of the chair. Two end components 66 and 67 contribute to the functional surface defined by the shaped edge surface of these units but are extended relative to the units so as to form a pair of legs. Spacers 68, 69, etc. and interconnecting means 70 are arranged in exactly the same fashion as discussed above. A second plurality of units 71, 72 and 73 are interposed between portions of adjacent pairs of the units of the first plurality. These second units constitute spacer means and define a second functional surface of the furniture piece, namely the seat of a chair. A third plurality of units, 74, 75 and 76, defining a third furniture surface, the front of the chair, are disposed at a point removed from the overlap of the first and second plurality of units. The second plurality of units are interposed between portions of opposed face surfaces of adjacent third plurality units. The outermost members (of which only 74 is shown) of this third plurality is extended, relative to the internal units, below the lower edge of the outermost member 71 of the second plurality so as to define a leg, analogous to the extension of outermost or end components 66 and 67 of the first plurality. In addition to interconnecting means 70, interconnecting means 77 and 78 are also provided to maintain these various pluralities of units in their respective spaced relationship.

It will be apparent that the foregoing method of construction is admirably suited to mass production since the individual units of any given plurality can be essentially interchanged. In such a case, the surface defined will be uniform. It is also possible to progressively alter the edge surface of each individual unit of a given plurality so that the surface defined by the composite of such units is, for example, concave (or convex) in the direction across the individual units. In such a case, it is advantageous to index the individual units of a given plurality to ensure the proper sequence of assembly.

It is also apparent that numerous modifications of this construction technique can be employed in order to define and construct a variety of furniture pieces. The specific embodiments described herein have thus been presented solely for purposes of exemplification and numerous other specific pieces can be constructed, utilizing the foregoing techniques and combinations thereof, without departing from the spirit of the invention.

What is claimed is:

1. A furniture piece comprising (a) a first plurality of units, each first plurality unit being of uniform thickness and having parallel side faces with at least one shaped edge surface, the composite of a portion of said edge surfaces defining at least one functional surface of said furniture piece when the units of said first plurality are positioned in a predetermined spaced face-to-face arrangement, (b) a plurality of discrete spacer means, (c) a second plurality of units of a configuration distinct from the units of said first plurality, each unit of said second plurality being disposed in said predetermined arrangement in face-to-face relationship with at least one unit of said first plurality transverse to the functional surface defined by said first plurality, said second plurality of units bearing at least a portion of the load of said first plurality of units, at least one of said spacers or a unit of said second plurality being disposed between the opposed faces of adjacent units of said first plurality and spacing said units of said first plurality from one another in said spaced arrangement, the units of each of said first and second plurality and said spacing means being provided with openings which are registered in said predetermined arrangement, and (d) interconnecting means operable to pass through said openings to maintain the units of said first and second plurality and said spacer means in said spaced arrangement.

2. A furniture piece according to claim 1 wherein the units of said second plurality have parallel side faces with at least one shaped edge surface, the composite of a portion of said edge surfaces when the units of said second plurality are arranged in said predetermined spaced face-to-face arrangement defining at least one functional surface distinct from and transverse to the functional surface defined by said first plurality of units.

3. A furniture piece according to claim 2 including a third plurality of units, the units of said third plurality being of uniform thickness and having parallel side faces with at least one shaped edge surface, the composite of a portion of said edge surfaces when the units of said second plurality are arranged in said predetermined spaced face-to-face arrangement defining at least one functional surface distinct from said first functional surfaces and transverse to at least said second functional surface, a portion of each individual unit of said second plurality being adjacent to at least one unit of said third plurality at a point removed from the intersection of the units of said second plurality and the units of said first plurality.

4. A furniture piece according to claim 1 wherein said interconnecting means comprises a rod passing through said openings.

5. A furniture piece according to claim 4 wherein said rod is cylindrical.

6. A furniture piece according to claim 1 wherein a plurality of registered openings are defined in each of said units.

7. A furniture piece according to claim 1 wherein the units of said first and second plurality are wood.

* * * * *